US011781776B2

(12) United States Patent
Kaneoya

(10) Patent No.: US 11,781,776 B2
(45) Date of Patent: Oct. 10, 2023

(54) CONTROL SUBSTRATE AND INDOOR EQUIPMENT OF AIR CONDITIONER

(71) Applicant: Mitsubishi Electric Corporation, Tokyo (JP)

(72) Inventor: Shinya Kaneoya, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 648 days.

(21) Appl. No.: 16/975,811

(22) PCT Filed: Apr. 18, 2018

(86) PCT No.: PCT/JP2018/015952
§ 371 (c)(1),
(2) Date: Aug. 26, 2020

(87) PCT Pub. No.: WO2019/202677
PCT Pub. Date: Oct. 24, 2019

(65) Prior Publication Data

US 2020/0408436 A1 Dec. 31, 2020

(51) Int. Cl.
*F24F 11/88* (2018.01)

(52) U.S. Cl.
CPC ..... *F24F 11/88* (2018.01)

(58) Field of Classification Search
CPC . F24F 11/30; F24F 11/62; F24F 11/88; H05K 1/18; H05K 2201/10189; H05K 7/1484; H02J 50/80
(Continued)

(56) References Cited

U.S. PATENT DOCUMENTS 8,987,946 B2 * 3/2015 Higashiyama ..... F24F 11/38 307/113
9,674,977 B2 6/2017 Kaneoya et al.
(Continued)

FOREIGN PATENT DOCUMENTS

EP 2 455 676 A2 5/2012
JP H08-312989 A 11/1996
(Continued)

OTHER PUBLICATIONS

International Search Report of the International Searching Authority dated Jul. 17, 2018 for the corresponding International application No. PCT/JP2018/015952 (and English translation).

*Primary Examiner* — Mandeep S Buttar
(74) *Attorney, Agent, or Firm* — POSZ LAW GROUP, PLC

(57) ABSTRACT

A control substrate includes a substrate, a power-supply circuit, a communication circuit, a first terminal block that includes a first wiring connector, a second wiring connector, and a third wiring connector, a second terminal block that includes a fourth wiring connector and a fifth wiring connector, a first pattern, a second pattern, a third pattern, a fourth pattern, a fifth pattern, a sixth pattern, a first switch that is provided in the third pattern and is capable of switching connection and disconnection between the second wiring connector and the communication circuit, and a second switch that is provided in the fifth pattern and is capable of switching connection and disconnection between the fourth wiring connector and the communication circuit.

4 Claims, 3 Drawing Sheets

(58) Field of Classification Search
USPC ..... 361/622
See application file for complete search history.

(56) References Cited

U.S. PATENT DOCUMENTS

| | | | | |
|---|---|---|---|---|
| 9,951,966 | B2 * | 4/2018 | Sawada | F24F 11/62 |
| 2007/0251250 | A1 * | 11/2007 | Meakawa | F24F 11/30 62/126 |
| 2008/0092570 | A1 * | 4/2008 | Choi | F24F 11/30 62/157 |

FOREIGN PATENT DOCUMENTS

| | | | |
|---|---|---|---|
| JP | H10-259929 | A | 9/1998 |
| JP | 2011-106801 | A | 6/2011 |
| JP | 2012-026651 | A | 2/2012 |
| JP | 2012-107817 | A | 6/2012 |
| JP | 2015-132450 | A | 7/2015 |

* cited by examiner

CONTROL SUBSTRATE AND INDOOR EQUIPMENT OF AIR CONDITIONER

CROSS REFERENCE TO RELATED APPLICATION

This application is a U.S. national stage application of International Patent Application No. PCT/JP2018/015952 filed on Apr. 18, 2018, the disclosure of which is incorporated herein by reference.

TECHNICAL FIELD

The present invention relates to a control substrate provided in an electrical component box of an indoor equipment and an indoor equipment of an air conditioner including the control substrate.

BACKGROUND

There are known various types of an indoor equipment of an air conditioner. For example, a four-way cassette-type indoor equipment described in Patent Literature 1 is configured to drive a motor installed in a housing of the indoor equipment to cause a blower connected to a shaft of the motor to rotate, thereby sucking indoor air through a bell mouth installed in the housing and discharging air, subjected to heat exchange in a heat exchanger, into a room. In this type of indoor equipment, an electrical component box that accommodates therein a control substrate for controlling the operation of the indoor equipment is arranged in the indoor equipment in many cases. In addition to the control substrate, a relay terminal block is provided in the electrical component box. The relay terminal block connects a terminal, for electrically connecting the indoor equipment and an outdoor equipment to each other, with a terminal for connecting a power line for supplying power to the indoor equipment.

As a method of supplying power to an indoor equipment and an outdoor equipment, there are known a separate power-receiving method and an external power-receiving method. In the separate power-receiving method, a power line extending from a power source is connected to each of the indoor equipment and the outdoor equipment to supply power. In the external power-receiving method, the power line is connected to the outdoor equipment only and power is supplied to the indoor equipment through a crossover line arranged to connect the outdoor equipment and the indoor equipment to each other. Generally, the separate power-receiving method and the external power-receiving method use different relay terminal blocks from each other. Further, at the time of installing an air conditioner, it may be necessary to exchange the relay terminal block to change to either one of the power supplying methods, that is, either the separate power-receiving method or the external power-receiving method.

PATENT LITERATURE

Patent Literature 1: Japanese Patent Application Laid-open No. 2011-106801

The indoor equipment described in Patent Literature 1 has a problem that the workload in association with switching of a power-receiving method is increased because, when the source from which the indoor equipment receives power is switched to the outdoor equipment or an external power source, the relay terminal block needs to be exchanged to a relay terminal block dedicated to the separate power-receiving method or to a relay terminal block dedicated to the external power-receiving method.

SUMMARY

The present invention has been achieved in view of the above problems, and it is an object of the present invention to prevent an increase of workload in association with switching of a power-receiving method.

To solve the above problems and achieve the object, a control substrate is provided in an indoor equipment of an air conditioner. The control substrate includes: a substrate; a power-supply circuit that is mounted on the substrate and generates power used in the indoor equipment; a communication circuit that is mounted on the substrate and causes an outdoor equipment, connected to the indoor equipment, and the indoor equipment to communicate with each other; a first terminal block that is mounted on the substrate and includes a first wiring connector, a second wiring connector, and a third wiring connector; a second terminal block that is mounted on the substrate and includes a fourth wiring connector and a fifth wiring connector; a first pattern that is formed on the substrate and connects the first wiring connector and the power-supply circuit to each other; a second pattern that is formed on the substrate and connects the second wiring connector and the power-supply circuit to each other; a third pattern that is formed on the substrate and connects the second wiring connector and the communication circuit to each other; a fourth pattern that is formed on the substrate and connects the third wiring connector and the communication circuit to each other; a fifth pattern that is formed on the substrate and connects the fourth wiring connector and the communication circuit to each other; a sixth pattern that is formed on the substrate and connects the fifth wiring connector and the communication circuit to each other; a first switch that is provided in the third pattern and is capable of switching connection and disconnection between the second wiring connector and the communication circuit; and a second switch that is provided in the fifth pattern and is capable of switching connection and disconnection between the fourth wiring connector and the communication circuit.

The control substrate according to the present invention has an effect where it is possible to prevent an increase of workload in association with switching of a power-receiving method.

DETAILED DESCRIPTION

A control substrate and an indoor equipment of an air conditioner according to embodiments of the present invention will be described in detail below with reference to the drawings. The present invention is not limited to the embodiments.

Embodiment

Figure 1:
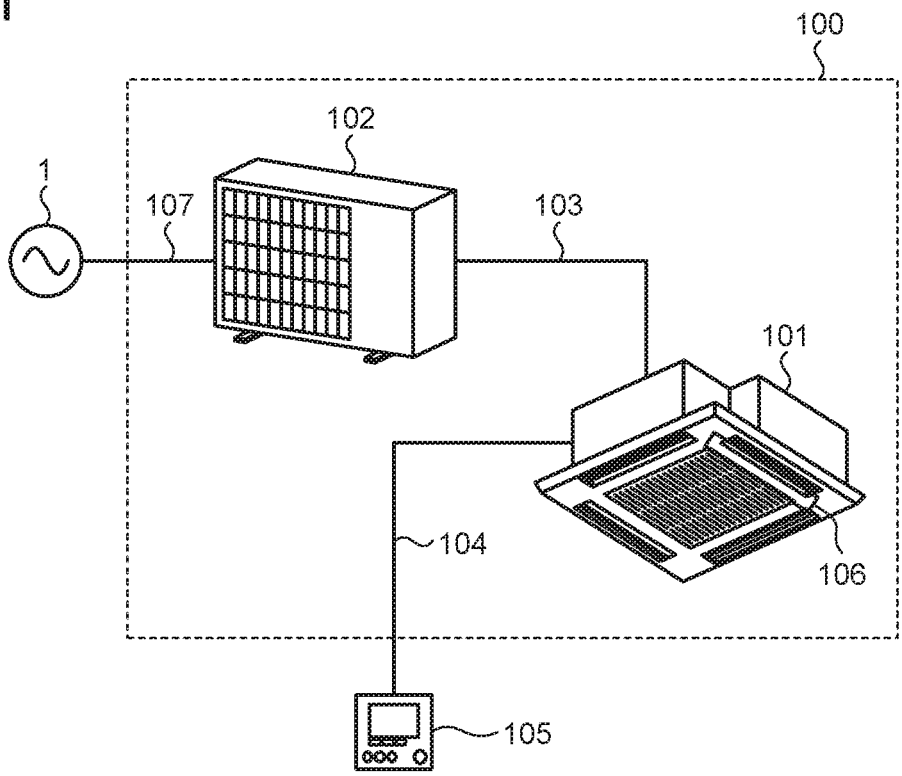
FIG. 1 is a diagram illustrating an air conditioner according to an embodiment in a case of an external power-receiving method.

An external power-receiving method and a separate power-receiving method that are power-receiving methods for an air conditioner are described. FIG. 1 is a diagram illustrating an air conditioner according to an embodiment of an external power-receiving method. An air conditioner 100 of an external power-receiving method is configured by an indoor equipment 101 installed indoors and an outdoor equipment 102 installed outdoors. The outdoor equipment 102 receives power from an external power source 1 via a power line 107. The indoor equipment 101 is connected to a remote controller 105 via a remote-controller communication wiring 104. The indoor equipment 101 is also connected to the outdoor equipment 102 via an indoor-outdoor connecting line 103. The indoor-outdoor connecting line 103 is a crossover line, and is used as a power-supply connecting line for supplying power from the outdoor equipment 102 to the indoor equipment 101 and a communication connecting line via which each of the outdoor equipment 102 and the indoor equipment 101 transmits/receives information related to control of air conditioning to/from each other. Transmission of information related to control of the operation of the air conditioner 100 is performed between the indoor equipment 101 and the remote controller 105 via the remote-controller communication wiring 104. An electrical component box 106 is incorporated in the indoor equipment 101.

Figure 2:
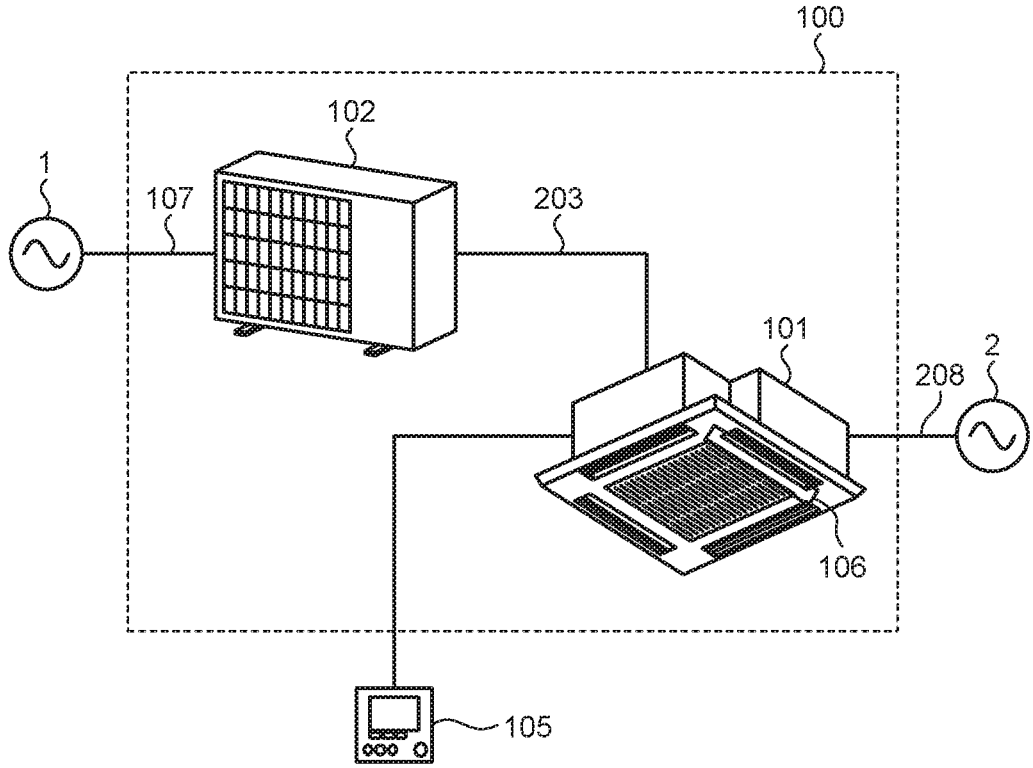
FIG. 2 is a diagram illustrating an air conditioner according to the embodiment in a case of a separate power-receiving method.

FIG. 2 is a diagram illustrating an air conditioner according to the embodiment of a separate power-receiving method. The indoor equipment 101 is connected to the outdoor equipment 102 via a communication connecting line 203. The communication connecting line 203 is used as a connecting line via which each of the outdoor equipment 102 and the indoor equipment 101 transmits/receives information related to control of air conditioning to/from each other. The indoor equipment 101 does not receive power supply via the outdoor equipment 102, but receives power from an external power source 2 via a power-supply connecting line 208.

Figure 3:
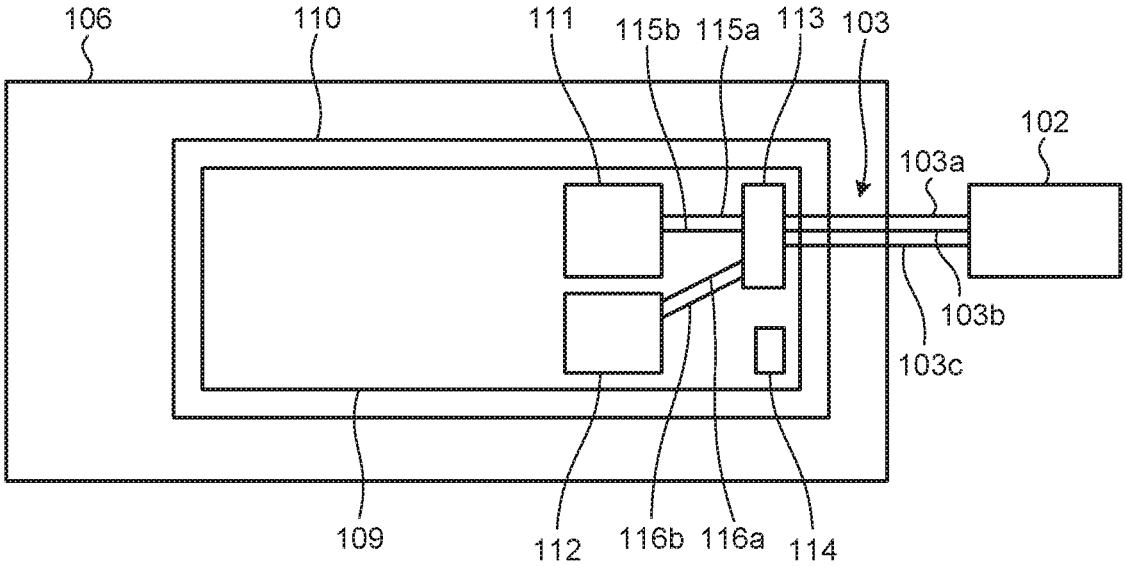
FIG. 3 is a conceptual diagram illustrating an internal configuration of an electrical component box of an indoor equipment according to the embodiment in a case of the external power-receiving method.

FIG. 3 is a conceptual diagram illustrating an internal configuration of the electrical component box 106 of the indoor equipment 101 according to the embodiment of the external power-receiving method. The electrical component box 106 includes a control substrate 110 for controlling the indoor equipment 101. The control substrate 110 includes a substrate 109, a power-supply circuit 111, a communication circuit 112, a first terminal block 113, and a second terminal block 114. The substrate 109 is a plate-like member. The power-supply circuit 111, the communication circuit 112, the first terminal block 113, and the second terminal block 114 are mounted on the substrate 109. The power-supply circuit 111 is a circuit that generates power that causes a microcomputer provided in the indoor equipment 101 and a drive circuit for an actuator provided in the indoor equipment 101 to operate. The communication circuit 112 is a circuit used for communication, required for air conditioning, between the indoor equipment 101 and the outdoor equipment 102. The first terminal block 113 is connected to the outdoor equipment 102 via the indoor-outdoor connecting line 103. The indoor-outdoor connecting line 103 is configured by a power-supply connecting line 103*a*, a shared connecting line 103*b*, and a communication connecting line 103*c* that are connected to the first terminal block 113. The power-supply connecting line 103*a* is a connecting line for supplying power to the power-supply circuit 111. The communication connecting line 103*c* is a connecting line used for transmitting information from the outdoor equipment 102 to the communication circuit 112 and transmitting information from the communication circuit 112 to the outdoor equipment 102. The shared connecting line 103*b* is a connecting line shared by supply of power and communication. The first terminal block 113 is connected to the power-supply circuit 111 via a power-supply connecting line 115*a* and a power-supply connecting line 115*b*. The first terminal block 113 is also connected to the communication circuit 112 via a communication connecting line 116*a* and a communication connecting line 116*b*.

Figure 4:
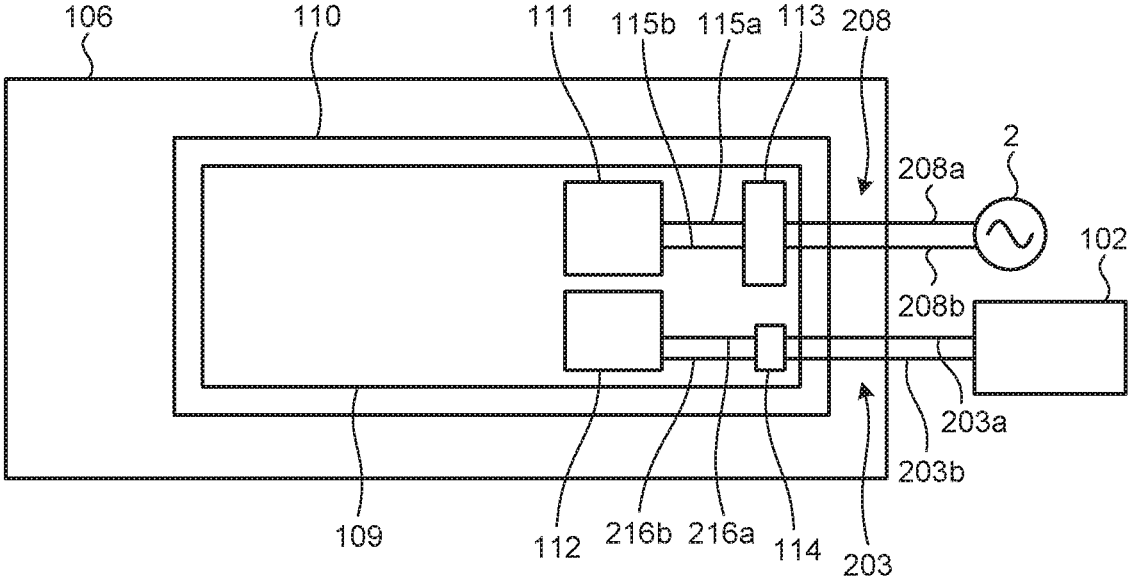
FIG. 4 is a conceptual diagram illustrating an internal configuration of an electrical component box of an indoor equipment according to the embodiment in a case of the separate power-receiving method.

FIG. 4 is a conceptual diagram illustrating an internal configuration of the electrical component box 106 of the indoor equipment 101 according to the embodiment of the separate power-receiving method. The first terminal block 113 is connected to the external power source 2 via the power-supply connecting line 208. The power-supply connecting line 208 is configured by a power-supply connecting line 208*a* and a power-supply connecting line 208*b* that are connected to the first terminal block 113. The second terminal block 114 is connected to the outdoor equipment 102 via the communication connecting line 203. The communication connecting line 203 is configured by a communication connecting line 203*a* and a communication connecting line 203*b* that are connected to the second terminal block 114. The first terminal block 113 is connected to the power-supply circuit 111 via the power-supply connecting line 115*a* and the power-supply connecting line 115*b*. The second terminal block 114 is connected to the communication circuit 112 via a communication connecting line 216*a* and a communication connecting line 216*b*. By providing two terminal blocks on the substrate 109 and switching the counterpart of connection of each of the two terminal blocks and each circuit depending on an external power-receiving method and a separate power-receiving method in this manner, it is unnecessary to exchange the terminal block. Next, a configuration for switching the counterpart of connection of each of the two terminal blocks and each circuit is described in detail.

Figure 5:
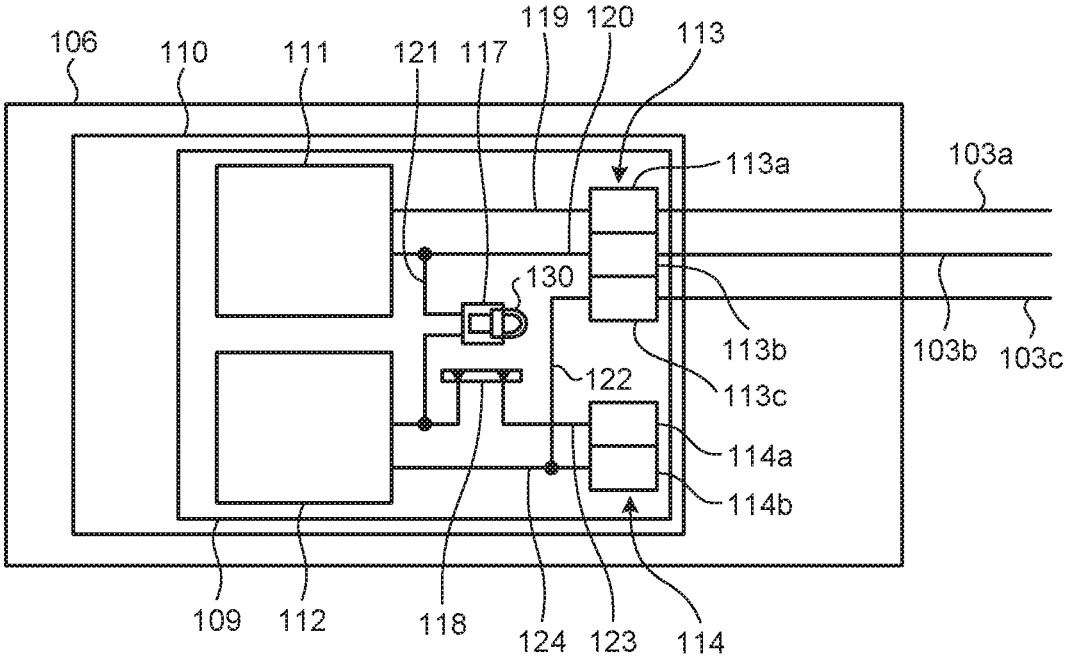
FIG. 5 is a diagram illustrating the internal configuration of the electrical component box of the indoor equipment according to the embodiment in a case of the external power-receiving method in detail.

FIG. 5 is a diagram illustrating the internal configuration of the electrical component box 106 of the indoor equipment 101 according to the embodiment of the external power-receiving method in detail. The substrate 109 includes a first switch 117 and a second switch 118. The first switch 117 and the second switch 118 are devices that prevent miswiring when circuits are switched. In the present embodiment, the first switch 117 and the second switch 118 are described as connectors that achieve connection by using a switching assistant 130 that is a jumper cable. However, the first switch 117 and the second switch 118 in the present invention are not limited to the jumper cable and the connectors, but may be mechanical relays or semiconductor switches such as photocouplers, for example. The switching assistant 130 is attached to either one of the first switch 117 and the second switch 118 and switches between: a state where a second wiring connector 113*b* and the communication circuit 112 are connected to each other; and a state where a fourth wiring connector 114*a* and the communication circuit 112 are connected to each other. Because there is only one switching assistant 130, when one of the switches is connected to a pattern, the other switch is not connected to the pattern. A state where the switching assistant 130 is inserted into a switch is referred to as "on", and a state where the switching assistant 130 is not inserted into the switch is referred to as "off".

The first terminal block 113 includes a first wiring connector 113*a*, the second wiring connector 113*b*, and a third wiring connector 113*c*. The second terminal block 114 includes the fourth wiring connector 114*a* and a fifth wiring connector 114*b*. The first wiring connector 113*a* is connected to the power-supply connecting line 103*a*, the second wiring connector 113*b* is connected to the shared connecting line 103*b*, and the third wiring connector 113*c* is connected to the communication connecting line 103*c*. The first wiring connector 113*a* is connected to the power-supply circuit 111 via a first pattern 119. The second wiring connector 113*b* is connected to the power-supply circuit 111 via a second pattern 120. The second wiring connector 113*b* is also connected to the communication circuit 112 via a third pattern 121. The first switch 117 is provided in the third pattern 121 and switches connection and disconnection between the second wiring connector 113*b* and the communication circuit 112 by using the switching assistant 130. FIG. 5 illustrates a state where a jumper cable that is the switching assistant 130 is inserted into a connector that is the first switch 117. The third wiring connector 113*c* is connected to the communication circuit 112 via a fourth pattern 122. The fourth wiring connector 114*a* is connected to the communication circuit 112 via a fifth pattern 123. The second switch 118 is provided in the fifth pattern 123 and switches connection and disconnection between the fourth wiring connector 114*a* and the communication circuit 112 by using the switching assistant 130. In FIG. 5, the jumper cable that is the switching assistant 130 is not inserted into a connector that is the second switch 118. The fifth wiring connector 114*b* is connected to the communication circuit 112 via a sixth pattern 124.

Because the first wiring connector 113*a* and the second wiring connector 113*b* are connected to the power-supply connecting line 103*a* and the shared connecting line 103*b*, respectively, a high-voltage current flows therethrough. Meanwhile, because the third wiring connector 113*c* is connected to the communication connecting line 103*c*, a current with a lower voltage flows through the third wiring connector 113*c*, as compared with the first wiring connector 113*a*. Although the fourth wiring connector 114*a* and the fifth wiring connector 114*b* are wiring connectors to be connected to communication connecting lines, there is no connecting line connected to the fourth wiring connector 114*a* and the fifth wiring connector 114*b* in a case of the external power-receiving method.

Figure 6:
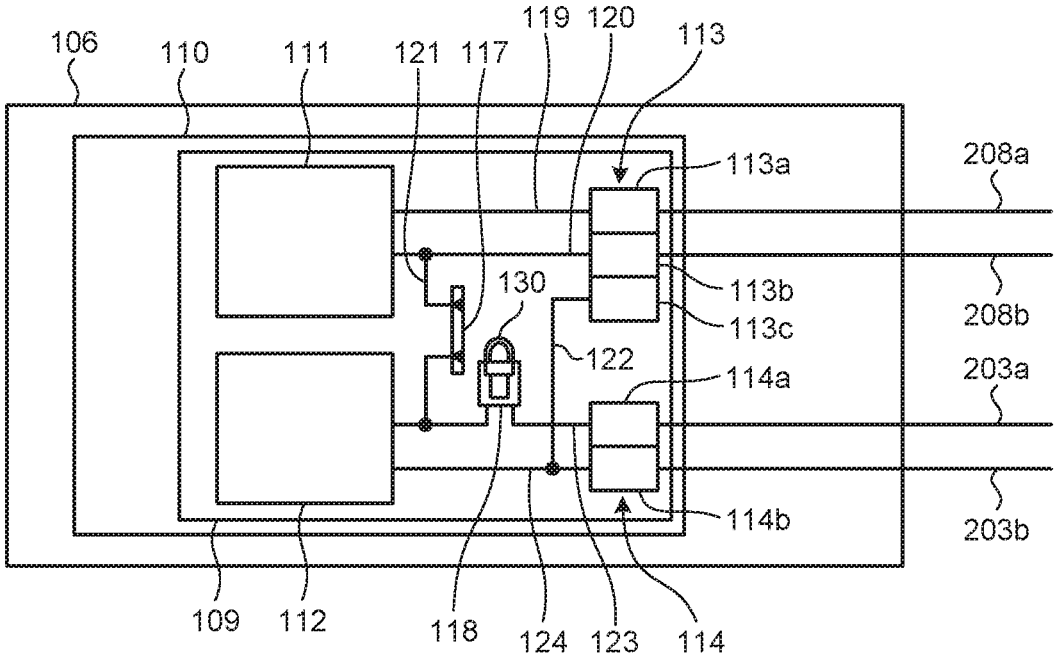
FIG. 6 is a diagram illustrating the internal configuration of the electrical component box of the indoor equipment according to the embodiment in a case of the separate power-receiving method in detail.

FIG. 6 is a diagram illustrating an internal configuration of the electrical component box 106 of the indoor equipment 101 according to the embodiment of the separate power-receiving method in detail. The first wiring connector 113*a* and the second wiring connector 113*b* are connected to the power-supply connecting line 208*a* and the power-supply connecting line 208*b*, respectively. The fourth wiring connector 114*a* and the fifth wiring connector 114*b* are connected to the communication connecting line 203*a* and the communication connecting line 203*b*, respectively. A high-voltage current flows through the first wiring connector 113*a* and the second wiring connector 113*b*. A current with a lower voltage than the current flowing through the first wiring connector 113*a* and the second wiring connector 113*b* flows through the fourth wiring connector 114*a* and the fifth wiring connector 114*b*. In a case of the separate power-receiving method, the second switch 118 is turned on and the first switch 117 is turned off. By becoming this state, the high-voltage current flowing from the second wiring connector 113*b* can be prevented from flowing into the communication circuit 112. Further, it becomes possible for the fourth wiring connector 114*a* to be connected to the communication circuit 112.

By providing the first switch 117 and the second switch 118, even if the power-supply connecting line 103*a* is erroneously connected to the fourth wiring connector 114*a* when an external power-receiving method is changed to a separate power-receiving method, that is, in the state of a control substrate illustrated in FIG. 5, a high-voltage current is prevented from flowing into the communication circuit 112 from the power-supply connecting line 103*a*, because the second switch 118 is off. Further, when the external power-receiving method is changed to the separate power-receiving method, the first switch 117 is turned off and the second switch 118 is turned on only after exchange of the connecting lines. Thus, even if the power-supply connecting line 208*b* is erroneously connected to the fourth wiring connector 114*a* at the time of exchanging the connecting lines, since the second switch 118 is still off at the time of exchange, it is possible to prevent failure of the communication circuit 112 caused by a high-voltage current As described above, because the control substrate 110 provided in the indoor equipment 101 includes the substrate 109, the first terminal block 113, and the second terminal block 114 on the control substrate 110, it is unnecessary to exchange a dedicated relay terminal block when a power-receiving method is switched. Therefore, an increase of workload in association with switch of the power-receiving method can be prevented. Further, because the control substrate 110 includes the first switch 117 and the second switch 118, it is possible to prevent failure of the communication circuit 112 even if a connecting line is connected to a wrong counterpart of connection when the power-receiving method is switched.

The configurations described in the above embodiments are only examples of the content of the present invention. The configurations can be combined with other well-known techniques, and part of each of the configurations can be omitted or modified without departing from the scope of the present invention.

The invention claimed is:

1. A control substrate provided in an indoor equipment of an air conditioner, the control substrate comprising:

a substrate;

a power-supply circuit that is mounted on the substrate and generates power used in the indoor equipment;

a communication circuit that is mounted on the substrate and causes an outdoor equipment, connected to the indoor equipment, and the indoor equipment to communicate with each other;

a first terminal block that is mounted on the substrate and includes a first wiring connector, a second wiring connector, and a third wiring connector;

a second terminal block that is mounted on the substrate and includes a fourth wiring connector and a fifth wiring connector;

a first pattern that is formed on the substrate and connects the first wiring connector and the power-supply circuit to each other;

a second pattern that is formed on the substrate and connects the second wiring connector and the power-supply circuit to each other;

a third pattern that is formed on the substrate and connects the second wiring connector and the communication circuit to each other;

a fourth pattern that is formed on the substrate and connects the third wiring connector and the communication circuit to each other;

a fifth pattern that is formed on the substrate and connects the fourth wiring connector and the communication circuit to each other;

a sixth pattern that is formed on the substrate and connects the fifth wiring connector and the communication circuit to each other;

a first switch that is provided in the third pattern and is capable of switching connection and disconnection between the second wiring connector and the communication circuit; and a second switch that is provided in the fifth pattern and is capable of switching connection and disconnection between the fourth wiring connector and the communication circuit, wherein when an indoor-outdoor connecting line, used to supply power from the outdoor equipment to the power-supply circuit and to transmit/receive information between the outdoor equipment and the communication circuit, is connected to the first terminal block, the first switch connects the second wiring connector and the communication circuit, and wherein when a power-supply connecting line, used to supply power from an external power source to the power-supply circuit, is connected to the first terminal block, and wherein when a communication connecting line, used to transmit/receive information between the outdoor equipment and the communication circuit, is connected to the second terminal block, the second switch (118) connects the fourth wiring connector (114*a*) and the communication circuit.

2. A control substrate provided in an indoor equipment of an air conditioner, the control substrate comprising:

a substrate;

a power-supply circuit that is mounted on the substrate and generates power used in the indoor equipment;

a communication circuit that is mounted on the substrate and causes an outdoor equipment, connected to the indoor equipment, and the indoor equipment to communicate with each other;

a first terminal block that is mounted on the substrate and includes a first wiring connector, a second wiring connector, and a third wiring connector;

a second terminal block that is mounted on the substrate and includes a fourth wiring connector and a fifth wiring connector;

a first pattern that is formed on the substrate and connects the first wiring connector and the power-supply circuit to each other;

a second pattern that is formed on the substrate and connects the second wiring connector and the power-supply circuit to each other;

a third pattern that is formed on the substrate and connects the second wiring connector and the communication circuit to each other;

a fourth pattern that is formed on the substrate and connects the third wiring connector and the communication circuit to each other;

a fifth pattern that is formed on the substrate and connects the fourth wiring connector and the communication circuit to each other;

a sixth pattern that is formed on the substrate and connects the fifth wiring connector and the communication circuit to each other;

a first switch that is provided in the third pattern and is capable of switching connection and disconnection between the second wiring connector and the communication circuit;

a second switch that is provided in the fifth pattern and is capable of switching connection and disconnection between the fourth wiring connector and the communication circuit; and a switching assistant that is attached to either one of the first switch and the second switch and switches between a state where the second wiring connector and the communication circuit are connected to each other and a state where the fourth wiring connector and the communication circuit are connected to each other.

3. An indoor equipment of an air conditioner comprising the control substrate according to claim 1.

4. An indoor equipment of an air conditioner comprising the control substrate according to claim 2.

* * * * *